US005650117A

United States Patent [19]

Kings et al.

[11] Patent Number: 5,650,117

[45] Date of Patent: Jul. 22, 1997

[54] SLAG DETECTING APPARATUS AND METHOD

[75] Inventors: Donald H. M. Kings, Bicester, England; Robin A. Sommers, Moon Township; John D. Usher, Beaver Falls, both of Pa.

[73] Assignee: Vesuvius Crucible Company, Wilmington, Del.

[21] Appl. No.: 534,988

[22] Filed: Sep. 27, 1995

[51] Int. Cl.[6] ..... C21D 11/00

[52] U.S. Cl. ..... 266/44; 266/78; 266/80; 266/90; 266/99

[58] Field of Search ..... 266/78, 79, 80, 266/94, 96, 99, 87, 44, 90

[56] References Cited

U.S. PATENT DOCUMENTS 4,160,948 7/1979 Tytgat et al. ..... 324/61 P 4,342,633 8/1982 Cure ..... 204/195 S 4,365,788 12/1982 Block ..... 266/78

5,375,816 12/1994 Ryan et al. ..... 266/44

*Primary Examiner*—Scott Kastler

*Attorney, Agent, or Firm*—Sixbey Friedman Leedom & Ferguson; Thomas W. Cole

[57] ABSTRACT

Both an apparatus and method for detecting slag in a flow of molten metal conducted through a ladle shroud are provided. In the apparatus, first and second conductive pins are mounted beside one another in a wall of the ladle shroud, the first being in contact with the flow of molten metal, but electrically insulated from both the wall and from the second conductive pin, the second being in electrical contact both with the wall and with the flow of molten metal. A voltmeter is connected between the two conductive pins for detecting differences in the electrical potential between them as molten metal flows through the shroud. Abrupt changes in potential caused by the passage of a metal slag interface through the shroud indicate the presence of slag in the molten metal.

25 Claims, 4 Drawing Sheets

SLAG DETECTING APPARATUS AND METHOD

BACKGROUND OF THE INVENTION

This invention generally relates to devices for detecting the presence of slag in a molten metal, and is particularly concerned with a slag detecting device of enhanced sensitivity and reliability for use on a ladle shroud in a facility for the continuous casting of steel.

As is illustrated in FIG. 1, in a continuous steel casting operation, the refined steel 1 is continuously poured from a ladle 3 into a tundish 5 through a pour opening 7 which may be opened or closed by a slide gate valve 12 (not shown). To prevent ambient oxygen from coming into contact with the flow 9 of liquid steel conducted from the ladle 3 to the tundish 5, a tubular shroud 11 is provided whose lower end 13 is disposed below the level 15 of steel 16 in the tundish 5. Steel poured into the tundish 5 is ultimately admitted through a second shroud 17 into a continuous casting mold (also not shown).

As a result of the previous refining processes that the steel 1 is subjected to in the ladle 3, a layer of slag 19 is built up over the upper surface of the steel 1. Ladle slag typically comprises calcium-alumino silicates, with smaller concentrations of magnesium, iron, and manganese oxides and other compounds in a molten state. While such slag 19 often serves the useful purpose of drawing out unwanted impurities in the steel (such as sulfur), it is also highly erosive to tundish refractories. Hence, it is important that the level of the steel 1 in the ladle 3 be continuously monitored so as to insure that no slag runs into the tundish 5 as the steel in the ladle is poured out. Such an unwanted flow of erosive slag can destroy the refractory lining that forms the inner surface of the tundish 5, and could contaminate the steel castings produced in the continuous casting mold.

To prevent the unwanted introduction of slag from a ladle into a tundish, several types of slag-detection devices have been developed. One such device comprises a coil through which a high frequency alternating current is passed in order to create a fluctuating magnetic field. The coil is placed near the discharge nozzle of the ladle and the tundish so that the fluctuating magnetic field it emanates can interact with the flow of molten steel. Because the magnetic permeability of slag is higher than that of molten steel, the impedance of the coil to the alternating current increases as soon as the slag is introduced into the flow of steel. Hence, the presence or absence of slag is detected by the continuous monitoring of the impedance of the coil. Unfortunately, such detectors are expensive, as it is difficult to economically manufacture such a coil-type slag detector which is capable of withstanding the elevated temperatures of approximately 1800° F. in the vicinity of the discharge nozzle. Moreover, such prior art detectors have not proven themselves to be sufficiently sensitive or reliable to allow the system operator to operate the ladle slide gate valve in such a manner to consistently prevent deleterious amounts of slag from entering the tundish while maximizing steel yield.

Because of these shortcomings, other types of slag detectors were developed, one of the most advanced being disclosed and claimed in U.S. Pat. No. 5,375,816. As is schematically illustrated in FIG. 1, this slag detector 20 comprises only a steel pin 21 mounted in the tubular shroud 11 such that its inner end comes into direct contact with the flow of molten steel. The outer end of the steel pin 21 is connected to a voltmeter 23 by way of a conductive wire 25. The voltmeter measures fluctuations in the potential between the steel pin 21 and a ground. This particular type of slag detector is based upon the surprising discovery that the presence of slag in the flow of steel generates a measurable increase in the electrical potential between the pin 21, and a ground. In contrast to coil-type slag detectors, this detector 21 is extremely simple and rugged in structure, and has proven to be, on the whole, at least as sensitive to the presence of slag as coil-type sensors.

However, despite the overall improvement that such conductive pin-type slag detectors represent, there is still a need for a slag detector having the simplicity and durability of such detectors, but greater sensitivity and reliability so as to allow the operator of the steel making facility even more time in which to react to prevent significant amounts of slag from flowing from a ladle to a tundish during a pouring operation.

SUMMARY OF THE INVENTION

The invention encompasses both an apparatus and a method for more sensitively and accurately detecting the presence of slag in a flow of molten metal, such as steel, by directly detecting the potential difference at the interface between the slag and the molten metal as it flows through a ladle shroud or other flow-directing metallurgical component. The apparatus of the invention comprises a first conductive pin mounted in a wall of the metallurgical component and having an end that comes into contact with the flow of molten metal, a second conductive pin likewise mounted in the component wall beside the first conductive pin and having an end in electrical contact with the flow of molten metal; an insulator for insulating the first conductive pin from both the component wall and the second conductive pin, and a voltmeter for detecting differences in the electrical potential between the first and second pins as molten metal flows through the walls of the shroud or other metallurgical component.

In the case where the shroud is formed from a semiconductive, graphite-containing ceramic material, the second conductive pin electrically communicates with the flow of molten metal through the shroud wall but is mechanically isolated from the flow by a portion of the thickness of the wall. In the case where the shroud wall is formed from an electrically insulative material, the second conductive pin has an end that comes into direct contact with the molten metal flowing therethrough. In either case, the resulting increase in slag detection accuracy and sensitivity is believed to come about from a more direct measurement of the potential difference existing between a boundary of molten metal and slag caused by an electrical double layer, which is only indirectly detected when the potential between the first conductive pin and a ground is measured.

While the spacing between the first and second conductive pins may be as great as one-half the length of the shroud, a close spacing of no more than 20 centimeters is preferred, and a closer spacing of 5 centimeters or less is most preferred. The spacing may be made either along the length or the circumference of the tubularly-shaped shroud walls, or both.

Both the first and second conductive pins may both be formed from a ferritic alloy, which is preferably low-carbon steel. While the first conductive pin extends completely through the thickness of the shroud wall, the second pin should extend through the wall no more than one-half of its thickness (when the shroud walls are semiconductive), and preferably no more than one-third the wall thickness. Both of the conductive pins are preferably connected to the voltmeter by means of a wire formed from an alloy of approximately 90% nickel and 10% chromium to avoid oxidation while providing good ductility. The gauge of the wire should be sufficiently heavy to be durable in the field.

In the method of the invention, two conductive pins are mounted in the wall of a shroud or other metallurgical component that conducts a flow of molten metal. One of the two conductive pins is insulated from both the balance of the shroud wall, as well as the second conductive pin. A voltmeter or other means for detecting differences in electrical potential between the first and second pins is then electrically connected between them. In the final step of the method, differences in electrical potential between the two pins are monitored as molten metal flows through the shroud. An abrupt difference in potential is indicative of the passage of a liquid metal/slag interface between the two conductive pins.

The invention provides both an apparatus and a method for detecting slag in a flow of molten metal with at least a 100% stronger signal than prior art slag detectors that measure only the potential between a single conductive pin and a ground.

BRIEF DESCRIPTION OF THE SEVERAL FIGURES

DETAILED DESCRIPTION OF THE PREFERRED EMBODIMENT

Figure 2:
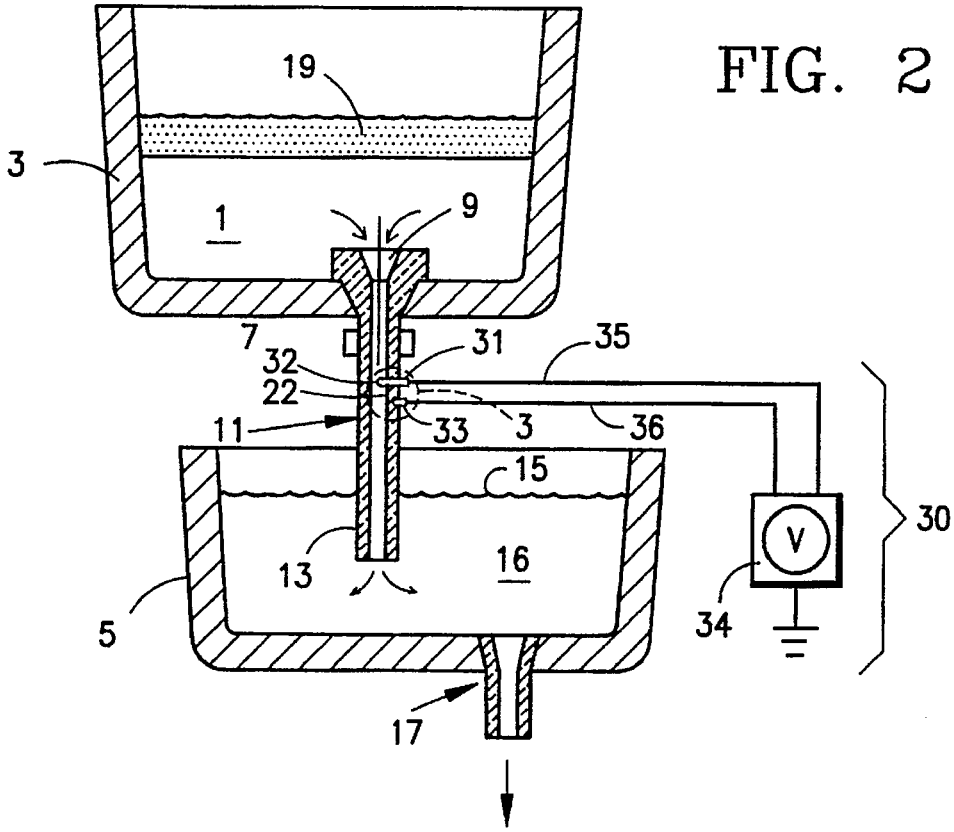
FIG. 2 is a schematized representation of the slag detector of the invention installed in the wall of a refractory shroud that conducts molten steel from a ladle to a tundish.

With reference now to FIG. 2, wherein like numbers designate like components throughout all the several figures, the slag detector 30 of the invention is particularly adapted for detecting the presence of slag in a flow of molten steel 1 poured from a ladle 3 into a tundish 5 via a shroud 11. To this end, the slag detector 30 includes an upper conductive pin 31 mounted in the tubular wall 22 of the shroud 11 and having a distal end 32 that comes into direct contact with the molten steel flowing therethrough. The slag detector 30 further includes a lower conductive pin 33 that is likewise mounted in the tubular wall 22 in close proximity to the upper conductive pin 31. Unlike the pin 31, the distal end of the lower conductive pin 33 does not extend completely through the tubular wall 22 to come into direct contact with molten steel flowing through the shroud 11. A voltmeter 34 is connected between the upper and lower conductive pins 31,33 by means of wires 35,36 formed from a heat-resistant nickel-chromium alloy, such as Chromel®. Both the upper and lower pins 31,33 are preferably formed from low carbon steel, although most any metal having a melting point equal to or greater than steel will operate satisfactorily for the purposes of the invention. Additionally, both of the pins 31,33 are cylindrically shaped as such a shape is the easiest to fit into the cylindrically shaped mounting bores that receive the pins 31,33 in the wall 22 of the shroud 11.

Figure 3A:
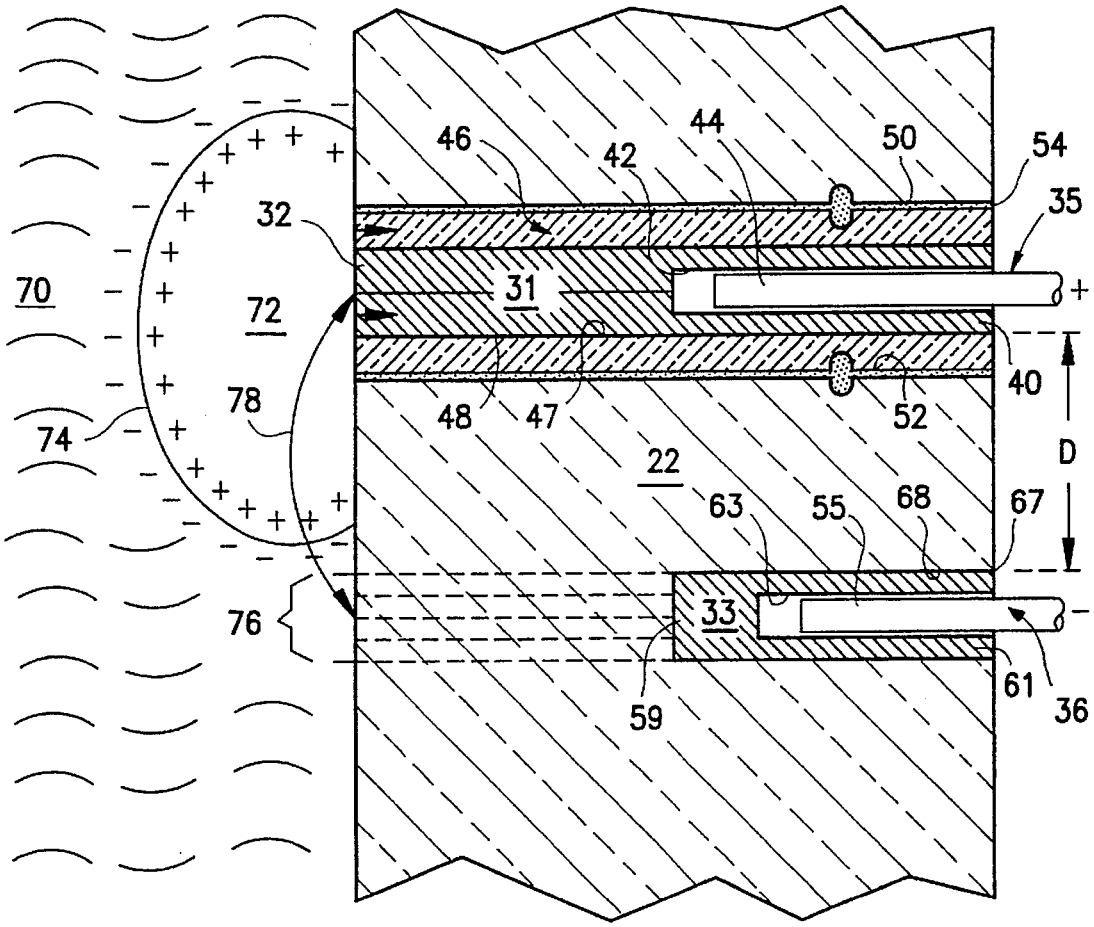
FIG. 3A is an enlarged, cross-sectional side view of the first embodiment of the slag detector of the invention illustrated in FIG. 2, illustrating the two conductive pins of the detector mounted in a semiconductive shroud, and how these pins detect the voltage differential created by the electrical double layer present in the boundary between the molten steel and slag flowing through the shroud.

With reference now to FIG. 3A, the upper pin 31 has a proximal end 40 that includes a bore 42 concentrically aligned with the cylindrical axis of the pin. This bore 42 receives the end 44 of the heat resistant wire in friction-fit relationship. In the preferred embodiment, the nickel-chromium wire 35 is a 16 gauge solid wire. Such a relatively heavy gauge lends durability to the slag detector 30, and further minimizes the electrical resistance experienced by the voltage signal transmitted from the distal end 32 of the pin 31 to the voltmeter 34.

In the FIG. 3A embodiment of the invention, the tubular wall 22 of the shroud 11 is formed from a graphite-containing ceramic, and hence is electrically semiconductive (i.e., having a conductivity of approximately $10^5$ mho, which is at the borderline between the definition of semi-conductive and conductive). Such conductivity necessitates electrically insulating the upper pin 31 from the tubular wall 22 of the shroud 11. Without such insulation, the pin 31 would be incapable of detecting variations in electrical potential that occur at local interfaces between molten steel and particles of slag mixed therein. To this end, the upper pin 31 is surrounded by a tubular sleeve 46 formed from a non-conductive ceramic material, such as high purity alumina. A layer of refractory cement 48 is disposed between the outer surface of the pin 31 and the inner surface 47 of the sleeve 46 in order to secure the pin to the sleeve. The outer surface 50 of the sleeve 46 is disposed within a bore 52 drilled or otherwise formed through the thickness of the shroud wall 22. The inner diameter of the bore 52 and the outer diameter of the sleeve 46 are closely matched so as to leave little space therebetween. A layer 54 of refractory cement is disposed between the outer surface 50 of the sleeve 46 and the bore 52 in order to secure the sleeve into the bore.

The lower pin 33 likewise has a distal end 59. However, the distal end 59 of the pin 33 of this embodiment does not extend completely through the thickness of the shroud wall 22, but instead stops somewhere between one-half and one-third of the thickness of the wall 22. Such an arrangement protects the distal end 59 of the lower pin 33 from coming into mechanical contact with molten metal flowing on the inside of the shroud wall 22, but allows it to come into electrical contact with this metal since the refractory material forming the shroud wall 22 contains electrically-conductive graphite. Lower conductive pin 33, like upper pin 31, has a proximal end 61 through which a concentrically aligned bore 63 is provided for receiving the end 55 of the heat-resistant wire 36. Further like the upper pin 31, a layer of refractory cement 67 secures the outer surface of the lower pin 33 to the inner surface of a cylindrical bore 68 drilled or otherwise provided in the side of the shroud wall 22.

While the distance D between the upper and lower pins 31,33 may be as much as half the length of the shroud 11 (which typically spans about 50 centimeters) a closer spacing of no more than 20 centimeters is preferred, and a closer spacing of 5 centimeters or less is more preferred. In this particular example of the invention, the distance D between the two pins 31,33 is 2.5 centimeters. While the distance D is indicated as being in the vertical direction, it could just as easily be along the circumference of the tubular shroud wall 22.

Figure 3B:
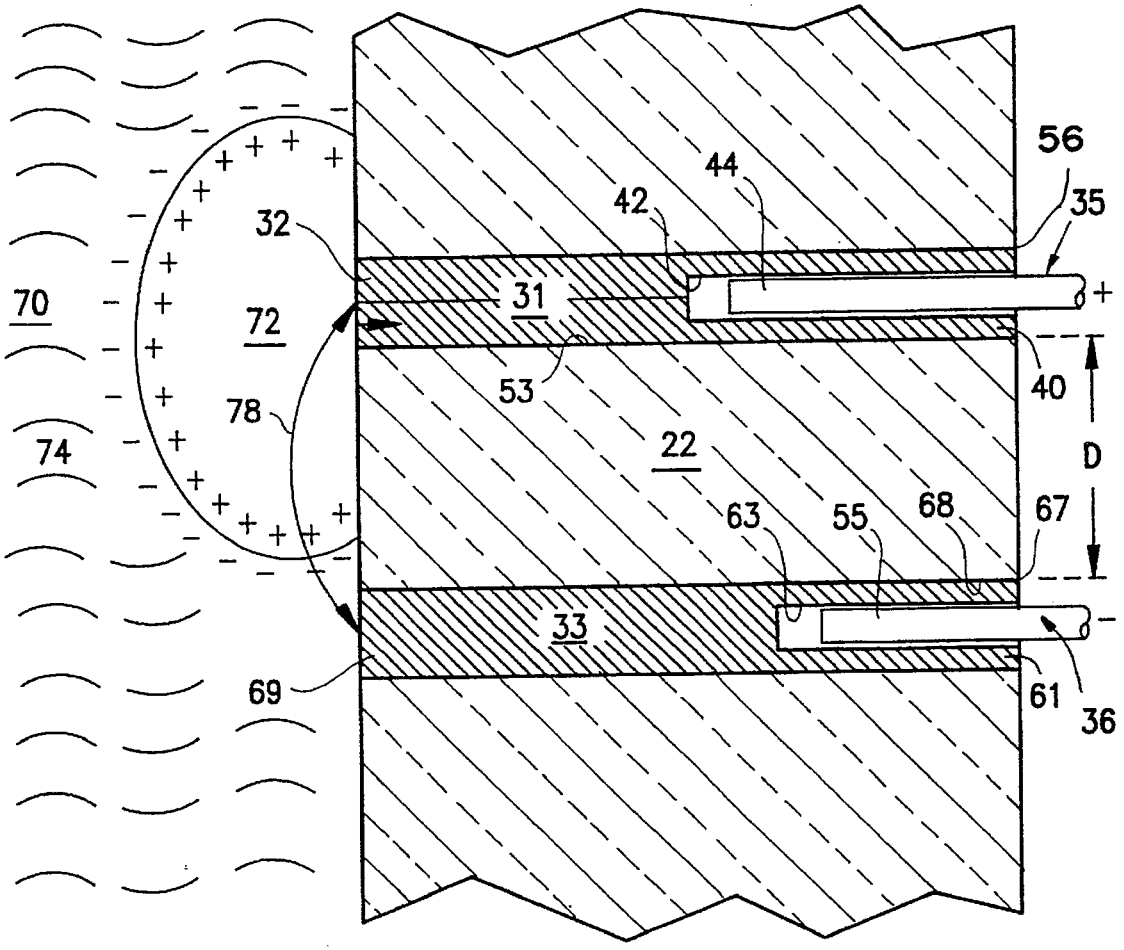
FIG. 3B is a cross-sectional side view of the conductive pins of a second embodiment of the invention mounted in an insulative shroud wall.

FIG. 3B illustrates an embodiment of the invention wherein the shroud wall 22 is not conductive or semiconductive, but instead is formed from an electrically insulating ceramic material. In this embodiment of the invention, there is no need for the tubular sleeve 46 of insulating material used in the FIG. 3A embodiment of the invention. The upper pin 31 is merely inserted within a closely-fitting bore 53 and secured therein by a layer 56 of refractory cement. Additionally, because the lower pin 33 must make actual contact with the molten metal 70 flowing through the shroud in order to come into electrical contact with it, the distal end 69 of the pin 33 in this embodiment extends all the way through the thickness of the shroud wall 22 as shown. In all other respects, the embodiment of FIG. 3B is the same as the embodiment as FIG. 3A.

The operation and method of the slag detector 30 of the invention will now be explained with respect to FIGS. 3A and 3B. When slag first begins to enter the flow 70 of molten steel that flows along the inner surface of the shroud wall 22, it breaks up into globules or particles 72 which become mixed in the molten steel 70. Such molten metal includes a significant concentration of positive metal ions, and free floating electrons. By contrast, the various molten oxides and silicates forming the slag 72 includes a mixture of oxide and silicate negative ions, in combination with positive metal ions. At the boundary 74 between the molten metal 70 and the molten slag 72, the free floating electrons present in the molten metal 70 attract the positive metal ions present in the molten slag 72, thereby creating a predominantly negatively charged layer of electrons that surrounds a positively charged layer of metal ions. The resulting electrical double layer creates a potential difference at the metal-slag interface 74 which in turn creates a potential difference between the upper and the lower pins 31,33 when these pins are at opposite sides of the interface 74. More specifically, a momentary voltage is created by the positive charges in contact with the distal end 32 of the upper conductive pin 31, and the negative charges that contact the conductive area 76 in the semiconductive shroud wall 22 closest to the distal end 59 of the lower conductive pin 33. The resulting potential between the two pins 31,33 is presented by the line 78.

Figure 1:
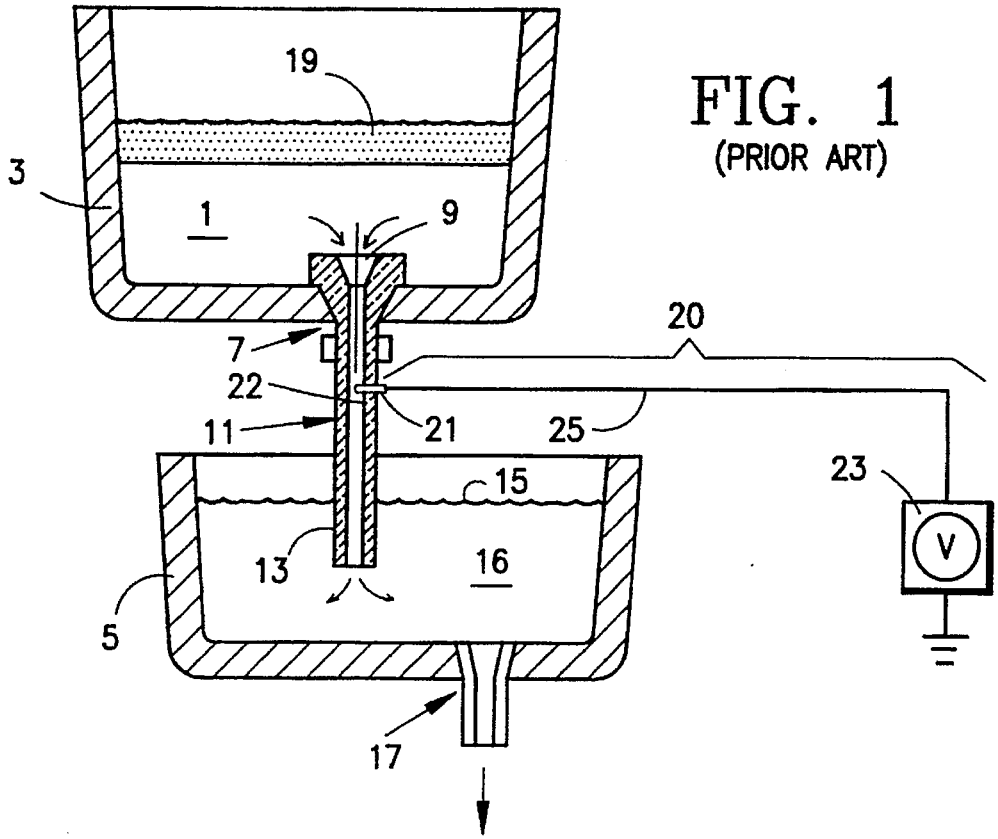
FIG. 1 (PRIOR ART)
FIG. 1 is a schematized representation of a prior art slag detector installed in a refractory shroud that conducts molten steel from a ladle to a tundish.
Figure 4A:
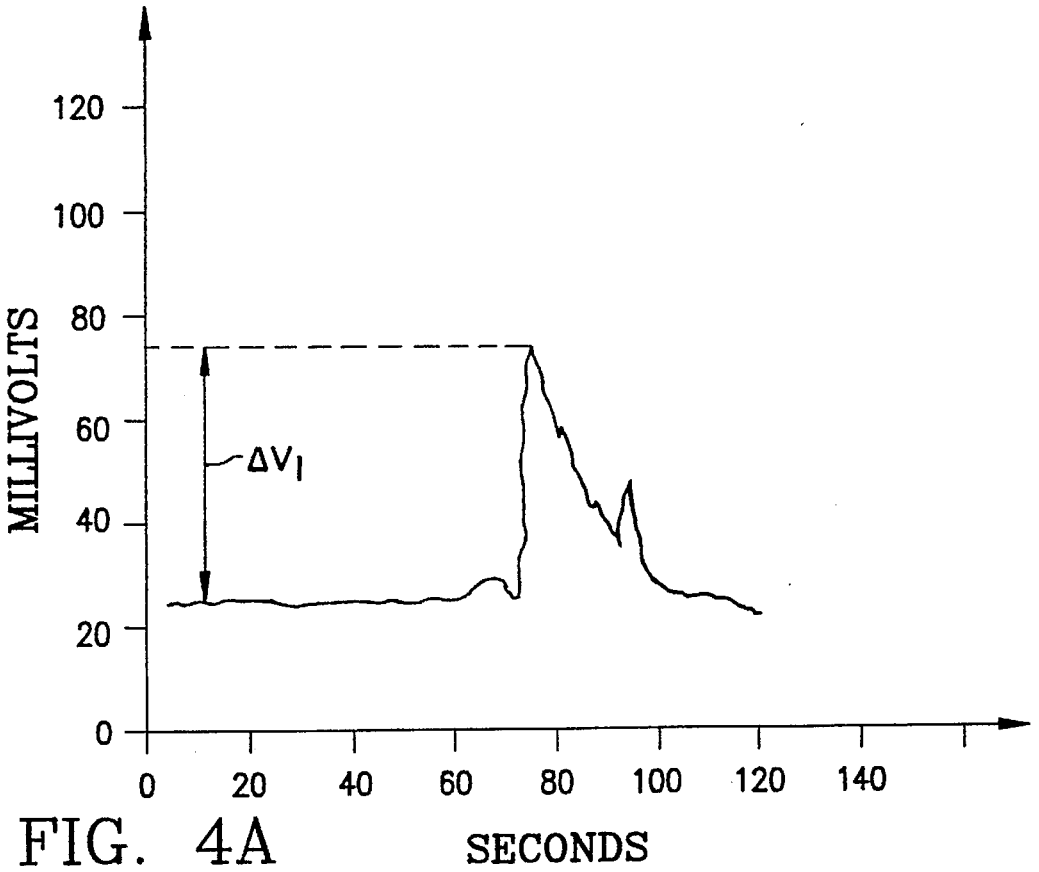
FIGS. 4A and 4B are graphs illustrating the magnitude of the slag detecting signal generated by a prior art slag detector and the slag detector of the invention, respectively.
Figure 4B:
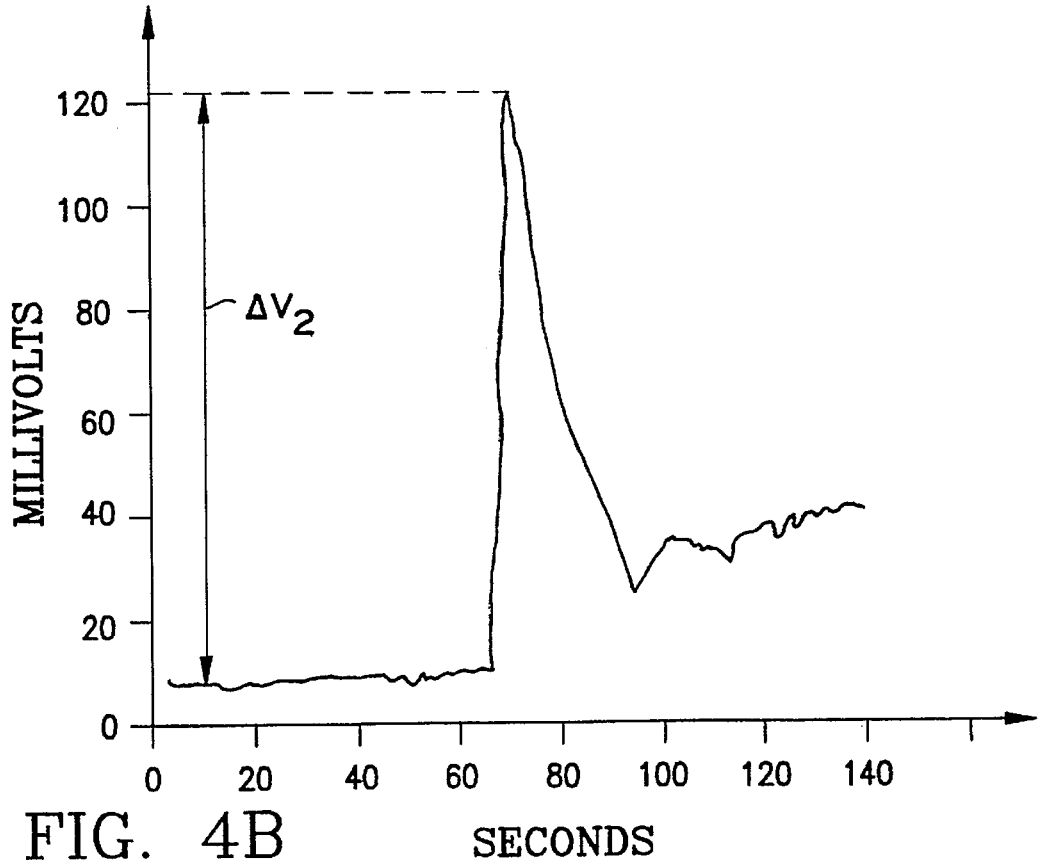

The improvement that the slag detector of the invention affords over the prior art is best appreciated by comparison of the millivolt over time graphs illustrated in FIGS. 4A and 4B. FIG. 4A represents the millivolt signal generated by the prior art slag detector 20 illustrated in FIG. 1, wherein only a single steel conductive pin 21 is connected to a ground by way of a voltmeter 23. In this particular example, the slag detecting signal begins to spike at about 70 seconds to a magnitude of approximately 75 millivolts. Because this signal is taken on top of a "base line" voltage of approximately 25 millivolts generated by thermocouple effects between the pin 21 and the molten steel surrounding it, the absolute magnitude of the slag detecting signal $\Delta V_1$ is only about 50 millivolts. By contrast, the magnitude of the slag detecting signal generated by a slag detector 30 of the invention is about 125 millivolts, as illustrated in FIG. 4B. As this signal is generated over a "base line" voltage of approximately 5 millivolts generated by thermocouple effects, the absolute magnitude of the slag detection signal $\Delta V_2$ generated by the slag detector 30 of the invention is approximately 120 millivolts. This represents an increase in signal magnitude of approximately 240%. This large increase in signal magnitude vastly increases the competence that the system operator has when first receiving the signal, due to the correspondingly higher signal to noise ratio between the 120 millivolt signal and noise generated by, for example, the electromagnetic coils that power induction-type furnaces. In this particular example, the upper and lower conductive pins 31,33 were approximately 2.5 centimeters apart in the tubular wall 22 of the shroud.

While this invention has been described with respect to a preferred embodiment, various modifications and changes will become apparent to persons of skill in the art. All such modifications, changes, and variations are intended to be encompassed within the scope this invention, which is limited only by the claims appended hereto.

What is claimed:

1. An apparatus for detecting slag in a flow of molten metal conducted through a metallurgical component having a length, comprising:

first conductor means mounted in a wall of said component and having a metallic end for coming into direct mechanical contact with said flow of molten metal;

second conductor means mounted in said component wall and having an end in electrical contact with said flow of molten metal said first and second conductor means being spaced apart no more than half said length of said component;

an insulator means for insulating said first conductor means from said component wall and said second conductor means, and means connected between said first and second conductor means for detecting variations in the electrical potential between said first and second conductor means caused by particles of slag in molten metal flowing through said component.

2. The apparatus of claim 1, wherein said component wall is electrically semiconductive, and wherein said second conductor is mechanically isolated from said flow of molten metal by a portion of said component wall.

3. The apparatus of claim 1, wherein said component wall is electrically insulative, and said insulator means is a portion of said wall immediately surrounding said first conductor means, and said second conductor means includes a metallic end for coming into direct mechanical contact with said molten metal.

4. The apparatus of claim 1, wherein said metallurgical component is a ladle shroud having walls formed from a semiconductive ceramic material, and said first and second conductor means are spaced apart no more than 20 cm.

5. The apparatus of claim 1, wherein said first and second conductor means are spaced apart no more than 5 cm.

6. The apparatus of claim 1, wherein said detection means is a voltmeter.

7. The apparatus of claim 1, wherein said first and second conductor means are metallic pins, and said flow of molten metal is molten steel.

8. The apparatus of claim 2, wherein said second conductor means extends through said wall between one-third and one-half the thickness of said component wall.

9. The apparatus of claim 1, wherein said detection means and said first and second conductor means are interconnected by a wire formed from a nickel and chromium alloy.

10. An apparatus for detecting slag in a flow of molten metal conducted through a metallurgical component having an electrically semiconductive wall, comprising:

first conductor means mounted in said semiconductive component wall and having a metallic end for coming into direct mechanical contact with said flow of molten metal;

insulator means for electrically insulating said first conductor means from said component wall;

second conductor means mounted in said wall in electrical contact with said flow of molten metal through said wall, said first and second conductor means being spaced apart no more than about 20 cm, and means connected between said first and second conductor means for detecting variations in the electrical potential between said first and second conductor means caused by particles of slag in a flow of molten metal through said component.

11. The apparatus of claim 10, wherein said second conductor means is mechanically isolated from said flow of molten metal by a portion of said component wall.

12. The apparatus of claim 10, wherein said first and second conductor means are no more than 10 centimeters from each other.

13. The apparatus of claim 10, wherein said detecting means is a voltmeter.

14. The apparatus of claim 10, wherein said metallurgical component is a ladle shroud formed from an electrically semiconductive ceramic material.

15. The apparatus of claim 10, wherein said electrically semi-conductive wall of said metallurgical component is formed from a graphite containing ceramic material.

16. The apparatus of claim 10, wherein each of said first and second conductor means is a metallic pin.

17. The apparatus of claim 10, wherein said first conductor means is formed from low carbon steel.

18. The apparatus of claim 10, wherein said second conductor means is a metallic pin that extends about halfway through the thickness of said semi-conductive wall.

19. An apparatus for detecting slag in a flow of molten metal conducted through a ladle shroud, having walls formed from an electrically semiconductive, graphite containing ceramic, comprising:

a first conductive pin mounted in a semiconductive wall of said shroud and having a metallic end for coming into direct mechanical contact with said flow of molten metal;

a second conductive pin mounted in said semiconductive shroud wall at a distance of no more than 5 cm from said first conductive pin, said second pin being in electrical contact with and mechanical isolation from said flow of molten metal by a portion of said semi-conductive wall;

a layer of insulation between said first conductive pin and said semiconductive shroud wall, and a voltmeter means for detecting variations in electrical potential between said first and second pins over time caused by particles of slag in a flow of molten metal through said component.

20. A method for detecting slag in a flow of molten metal conducted through a metallurgical component, comprising the steps of:

mounting first and second conductive pins in a wall of said component, the first pin having a metallic end for mechanically and electrically contacting said flow, the second pin having an end for electrically contacting said flow, wherein said ends of said pins are no more than 10 cm from each other;

insulating said first pin from said wall and said second pin, and monitoring variations in the electrical potential between said first and second pins while said flow of molten metal is conducted through said component in order to detect the presence of slag particles.

21. A method for detecting slag in a flow of molten metal conducted through a metallurgical component having a wall that is at least electrically semiconductive, comprising the steps of:

mounting a first metallic conductor means in said wall of said component such that a metallic end of said first means mechanically and electrically contacts said flow, mounting a second conductor means on said wall of said component within 20 cm of said first conductor means such that said second conductor means is in electrical contact with said flow through said wall but is mechanically isolated from said flow by said wall;

insulating said first conductor means from said wall and said second conductor means, and monitoring variations in the electrical potential between said first and second conductor means while said flow of molten metal is conducted through said component to detect the presence of particles of slag in said flow.

22. The method of detecting slag defined in claim 21, wherein said second conductor means is mounted by forming a recess in said wall, and inserting said second conductor means into said recess.

23. An apparatus for detecting slag in a flow of molten metal conducted through an elongated metallurgical component having a wall that is at least electrically semiconductive, comprising:

first conductor means mounted in said wall of said component and having a metallic end for coming into direct mechanical contact with said flow of molten metal;

second conductor means mounted on said component wall a distance from said first conductor component, in electrical contact with said flow of molten metal through said wall but mechanically isolated from said flow by said wall;

an insulator means for insulating said first conductor means from said component wall and said second conductor means, and means connected between said first and second conductor means for detecting variations in the electrical potential between said first and second conductor means caused by particles of slag in a flow of molten metal through said component.

24. The apparatus of claim 23, wherein said second conductor means is mounted in a recess present in said wall of said component, and said component is a ladle shroud formed from an electrically semiconductive ceramic material.

25. The apparatus of claim 24, wherein said recess is a bore extending partially through said wall, and said second conductor means is a metal pin disposed in said bore.

* * * * *